US009724659B2

(12) United States Patent
Abraham et al.

(10) Patent No.: US 9,724,659 B2
(45) Date of Patent: Aug. 8, 2017

(54) STIRRING DEVICE AND METHOD USING ELECTROSTATIC CHARGE

(71) Applicant: FLEXTRONICS AP, LLC, Broomfield, CO (US)

(72) Inventors: Susan Abraham, San Jose, CA (US); Dennis Willie, San Jose, CA (US)

(73) Assignee: Flextronics AP, LLC, San Jose, CA (US)

( * ) Notice: Subject to any disclaimer, the term of this patent is extended or adjusted under 35 U.S.C. 154(b) by 265 days.

(21) Appl. No.: 14/574,983

(22) Filed: Dec. 18, 2014

(65) Prior Publication Data

US 2016/0175792 A1 Jun. 23, 2016

(51) Int. Cl.
*B01F 13/00* (2006.01)

(52) U.S. Cl.
CPC ..... *B01F 13/0003* (2013.01); *B01F 13/0005* (2013.01); *B01F 13/0076* (2013.01)

(58) Field of Classification Search
CPC ..... B01F 13/0003; B01F 13/0005; B01F 13/0076
USPC ..... 366/DIG. 3, DIG. 4
See application file for complete search history.

(56) References Cited

U.S. PATENT DOCUMENTS 4,161,439 A * 7/1979 Warren ..... B01D 11/0419 204/660
4,606,801 A * 8/1986 Prestridge ..... B01D 17/06 204/570
4,989,605 A * 2/1991 Rossen ..... A61N 1/36021 128/907
6,860,979 B2 * 3/2005 Sams ..... B01D 17/00 204/556
7,361,255 B1 * 4/2008 Kuhry ..... A23L 2/50 204/164
9,181,113 B2 * 11/2015 Clark ..... C02F 1/487
2016/0175792 A1 * 6/2016 Abraham ..... B01F 13/0003 366/341

* cited by examiner

*Primary Examiner* — Tony G Soohoo
(74) *Attorney, Agent, or Firm* — Volpe and Koenig, P.C.

(57) ABSTRACT

A stirring device and method for stirring a material using an applicator with an electrically controllable element placed on an outside surface of the applicator so that a controllable power source coupled to the electrically controllable element provides a controlled electrostatic charge to the element. The controlled electrostatic charge provided by the power source creates a variable electric field exterior to the outside surface of the applicator. The variable electric field induces a stirring movement to the material.

16 Claims, 3 Drawing Sheets

STIRRING DEVICE AND METHOD USING ELECTROSTATIC CHARGE

FIELD OF INVENTION

Embodiments of the present disclosure generally relate to a stirring device and method, more particularly, a stirring device and method using an electrostatic charge.

BACKGROUND

The invention relates to a stirring device and method of stirring a liquid, a solid, or other material forms using electrostatic charge to create a stirring effect.

Stirring devices typically include a mechanical stirrer immersed in the media to be stirred and a motive force applied to the mechanical stirrer to stir the media. Current stirring devices require contact between the moving mechanical stirrer and the media. In some applications, it may desirable to keep the media free from contact with a moving stirrer while the media is stirred. In some applications, it may be desirable to eliminate mechanically moving components in a stirring device. No known stirring devices can be used in such an application.

Accordingly, a need exists for a stirring device and method in which contact between the media to be stirred and a mechanical stirrer is avoided and a mechanically moving stirrer is eliminated.

SUMMARY

Embodiments of a stirring device and method of stirring a media, or material, are provided herein. In an embodiment, a stirring device comprises an applicator comprising an electrically controllable element disposed on an outside surface and a controllable power source coupled to the electrically controllable element. The power source provides a controlled electrostatic charge, which may be based on electroadhesion methods, to the element so that a variable electric field is formed exterior to the outside surface.

In an embodiment, a method of stirring comprises providing a vessel and placing a material to be stirred in the vessel. An applicator comprising an electrically controllable element disposed on an outside surface is placed in the vessel so that the electrically controllable element is disposed within the material to be stirred. A controllable power source is coupled to the applicator and a controlled electrostatic charge, which may be based on electroadhesion methods, is applied from the controllable power source to the element, forming a variable electric field exterior to the outside surface of the applicator. The material is stirred using the variable electric field.

Other and further embodiments of the present invention are described below.

BRIEF DESCRIPTION OF THE DRAWING(S)

Embodiments of the present invention, briefly summarized above and discussed in greater detail below, can be understood by reference to the illustrative embodiments of the invention depicted in the appended drawings. It is to be noted, however, that the appended drawings illustrate only typical embodiments of this invention and are therefore not to be considered limiting of its scope, for the invention may admit to other equally effective embodiments.

Figure 5:
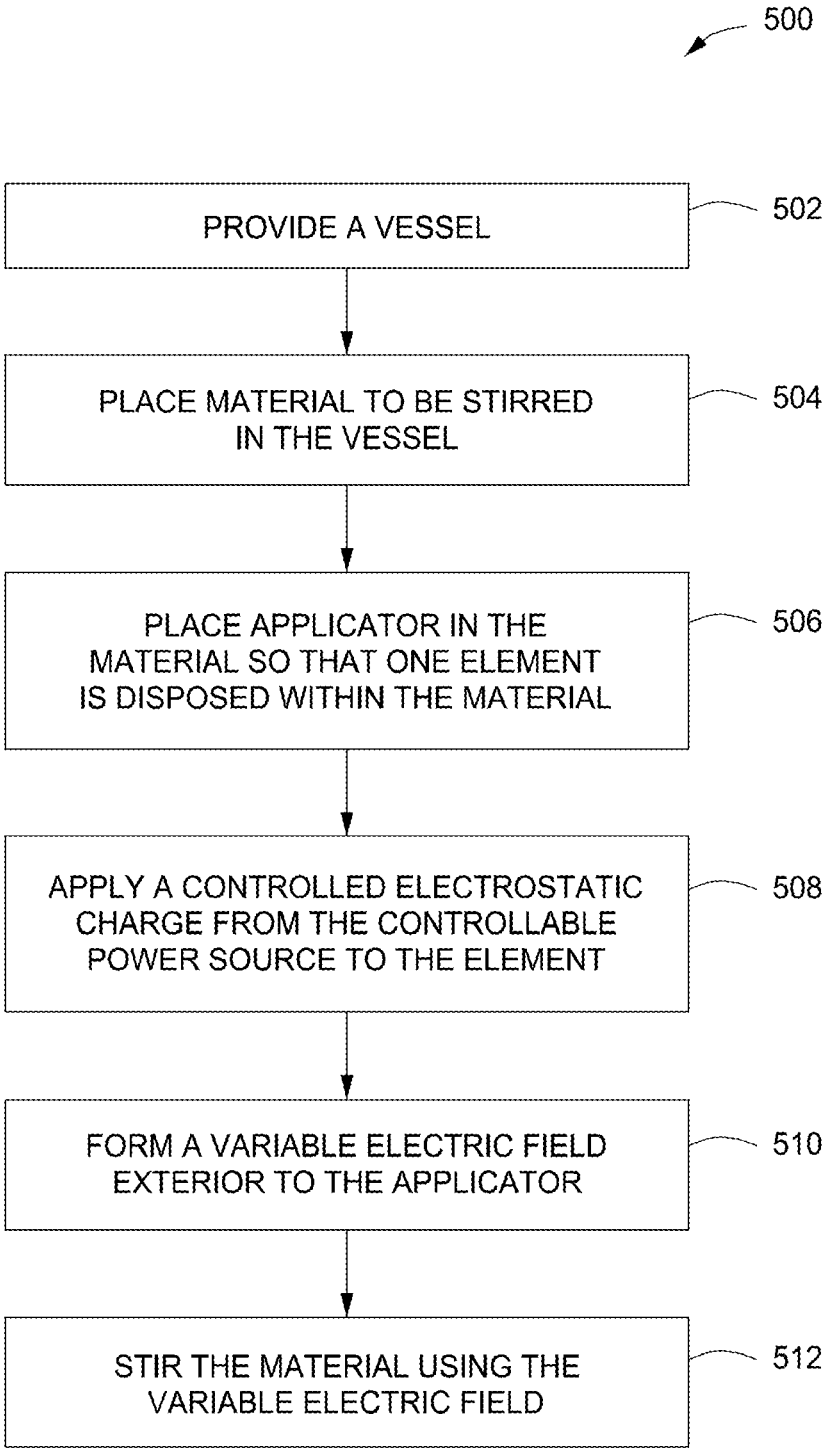

FIG. 5 is a flow diagram illustrating an method according to n embodiment of the invention To facilitate understanding, identical reference numerals have been used, where possible, to designate identical elements that are common in the figures. The figures are not drawn to scale and may be simplified for clarity. It is contemplated that elements and features of one embodiment may be beneficially incorporated in other embodiments without further recitation.

While described in reference to a stirring device for use liquids and granular solids, the present invention may be modified for a variety of applications while remaining within the spirit and scope of the claimed invention, since the range of the potential applications is great, and because it is intended that the present invention be adaptable to many such variations.

DETAILED DESCRIPTION

Certain terminology is used in the following description for convenience only and is not limiting. "Simultaneously" is used to mean occurring at, or approximately at, the same time. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

Figure 1:
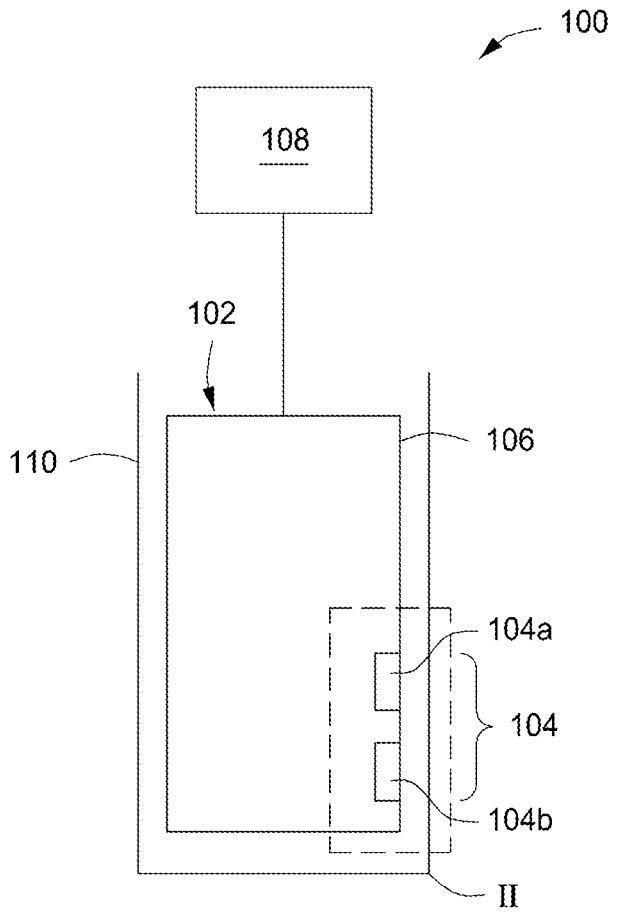
FIG. 1 is a side schematic view of a stirring device according to an embodiment.

FIG. 1 depicts a stirring device 100 in accordance with an embodiment of the disclosure. The stirring device 100 includes an applicator 102 comprising an electrically controllable element, element 104, embedded or disposed on an outside surface 106 of the applicator 102. The applicator 102 is shown in a side view as a rectangle for ease of illustration. The applicator 102 may be rectangular or circular in cross section in some embodiments, while in others it may have more complex cross sections. Non-limiting examples of alternate cross sectional shapes include triangular, oval, or cruciform.

The element 104 preferably includes at least a first electrode 104*a* and a second electrode 104*b*. One controllable element 104 is shown for ease of illustration as multiple elements 104, each preferably including at least a first and a second electrode are anticipated. In a preferred embodiment, the element 104 includes multiple pairs of electrodes (e.g., 104*a*, 104*b*) which can create pulsed electrostatic charges by turning on and turning off (i.e., cycling) an electric field. The pulsed electrostatic charge can be created in a specific pattern, including in non-limiting examples circular or semi-circular patterns. When cycled continuously, the pulsed field continuously alternates between attracting and not attracting, or dropping, particles of material within the field. When the pulsed field is applied to some materials, for example liquids or granular solids, a movement within the material suitable for stirring the material can be induced.

The applicator 102 may be formed from any material suitable for maintaining a static charge which is created, for example, by electroadhesion methods. The electrodes (e.g., 104*a*, 104*b*) are embedded in the applicator 102 so that, when energized, the applicator 102 develops a charge on that region of the applicator 102 and develops an opposite charge on the adjacent media. In essence, when an electrode (104*a*, 104*b*) is energized (i.e., the electrode is "on"), if the applicator 102 develops a positive charge on that region, media within the electric field develops a negative charge based on electroadhesion principles and is adhered to the applicator. When the electrode (104*a*, 104*b*) is de-energized (i.e., the electrode is "off"), all charges on the applicator 102 become null, including residual charges, and the media drops from the applicator 102. The applicator 102 may also provide insulation between electrodes 104*a* and 104*b*.

A controllable power source 108 is electrically coupled to the element 104 to selectively provide electrical power to the element 104. In an embodiment, the power source 108 provides a controlled pulsed electrostatic charge to the element 104 so that a pulsed electric field is formed exterior to the outside surface of the applicator 102.

In an embodiment, the controlled power source 108 provides a pulsed power to the element 104. As used herein, "pulsed power" or other forms thereof may mean the power is pulsed between an energized condition and a de-energized condition (sometimes referred to as being "on" or "off"). "Pulsed power" may also mean the polarity is pulsed between a first polarity and a second polarity, for example between a positive polarity (+) and a negative polarity (−). "Pulsed power" could also mean the power level is pulsed between a first power level and a second power level.

In embodiments having first and second electrodes 104*a*, 104*b*, the controllable power source 108 is electrically coupled separately to the electrodes to provide each electrode with an electrostatic charge independent of the other electrode. The electrodes may receive pulsed power as described above. Polarity, frequency and power level of the electrostatic charge to each electrode (e.g., 104*a*, 104*b*) may be individually controlled.

In an embodiment, the controllable power supply 108 provides the first electrode 104*a* and the second electrode 104*b* with an electrostatic charge of opposite polarity. For example the first electrode 104*a* receives an electrostatic charge to provide a positive polarity while the second electrode 104*b* receives an electrostatic charge to provide a negative polarity. The controllable power supply 108 may provide the first electrode 104*a* with the first polarity while simultaneously providing the second electrode 104*b* with the second, or opposite, polarity. The first electrode 104*a* and the second electrode 104*b* may be simultaneously changed, or pulsed, from an energized condition to a de-energized condition, in a timed, cyclic pattern. The cycling between energized and de-energized conditions may continue for a predetermined time or number of cycles as controlled by the controllable power source 108.

"Simultaneously" as used herein anticipates delays due to switching conditions, transmission delays, equipment limitations, and other factors which prevent the two events from occurring at precisely the same time.

In an embodiment, the polarity of the first and second electrodes 104*a*, 104*b* may be changed, or pulsed. For example, the first electrode 104*a* may be changed from a positive polarity to a negative polarity while the second electrode is changed from a negative polarity to a positive polarity. Within the limitations discussed above, the change in polarity may take place simultaneously.

Figure 2:
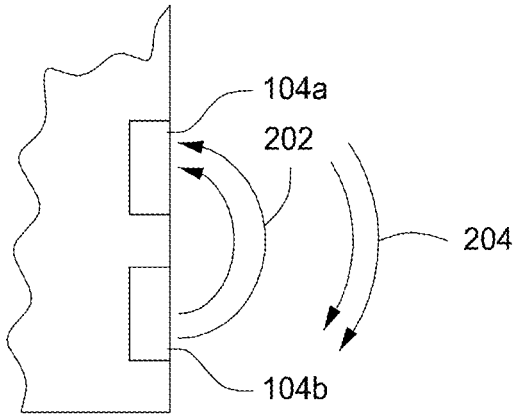
FIG. 2 is an enlarged view of the area II of FIG. 1

When energized by the controllable power supply 108, the first and second electrodes 104*a* and 104*b* create an electric field 202 (represented by arrows 202 drawn in accordance with a convention used to describe and electric field) as illustrated in FIG. 2. The electric field 202 is at least found to the exterior of the applicator 102, although it may exist in the interior as well. The electric field 202 may be a variable field as the first and second electrodes 104*a*, 104*b* are pulsed as described above. The electric field 202 may vary in strength as the electrodes cycle between energized and de-energized conditions, and may reach a minimum strength when the electrodes are de-energized.

The direction of the electric field 202 may change with changing polarity of the first and second electrodes 104*a*, 104*b*, also creating a variable electric field. For example, the direction of the electric field 202 may be as drawn when the first electrode 104*a* is charged with a first polarity and the second electrode is charged with a second polarity. When the polarity switches and the first electrode 104*a* is charged with a second polarity and the second electrode 104*b* is charged with a first polarity, the electric field thus formed may switch direction, and electric field 204 (represented by arrows 204 drawn in accordance with a convention used to describe and electric field) may result.

The applicator 102 may be partially or wholly within a sheath 110. The sheath 110 may protect the applicator 102 and element 104 from contamination or damage. The sheath 110 may be formed from any suitable material at least partially transparent to electric field 202.

In practice, the stirring device 100 may be used to stir a material or substance without movement of the applicator 102 with respect to the material being stirred. Conventional stirring devices typically include a mechanical agitator or stirring rod of some design that moves relative to the material or materials being stirred. The inventors have observed that in some instances, this movement and contact with the material to be stirred is undesirable. For instance, the material may be caustic to the mechanical stirrer, or may react with the stirrer to create an unwanted chemical reaction. In other instances, the material to be stirred may be difficult to clean from the stirrer, leading to time consuming cleaning processes.

In the described stirring device, the deficiencies in the conventional devices are at least partially overcome.

FIG. 5 is flow chart 500 illustrative of the practice of an embodiment of the method. A container or vessel 302 of suitable size and construction to contain the material 304 to be stirred is provided at 502. The material 304 may be comprised of one or more materials, and may be distinct and/or separable materials. The material 304 may comprise one or more solids in granular form of various sizes, or may comprise liquids, pastes, or suspensions of various densities and viscosities (collectively liquids), or may be a mixture of one or more solids and one or more liquids, but not limited to these states or combinations.

Figure 3:
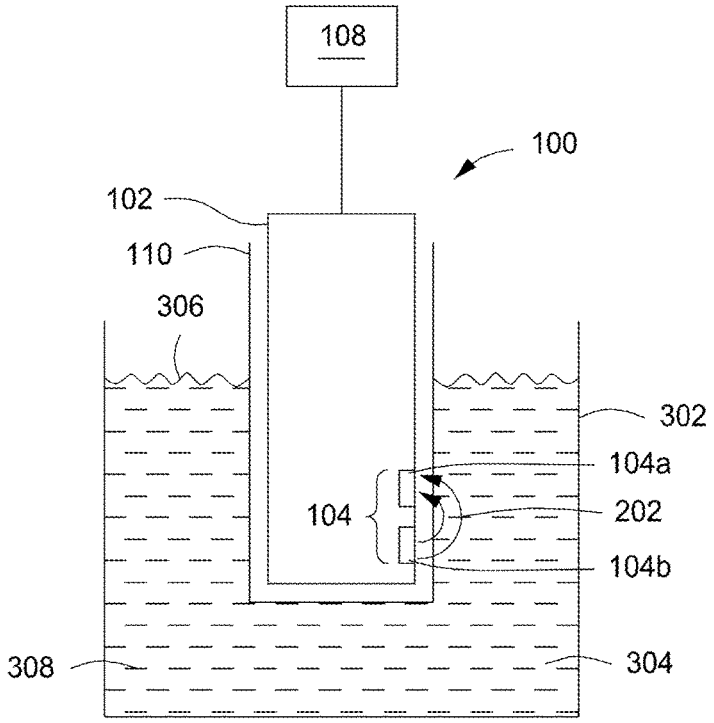
FIG. 3 is a side schematic view of the stirring device of FIG. 1 in use according to an embodiment of the invention.

The material 304 is placed in the vessel 302 at 504 and the applicator 102 is placed in the material 304 so that at least one element 104, preferably comprising at least first and second electrodes 104*a* and 104*b*, is disposed within the material 304 to be stirred at 506. That is, one or more elements 104 (one shown) are placed in the material 304 below the surface 306 of the material. The element 104 may be at the bottom 308 of the material 304, but is not necessarily adjacent to, or in contact with, the bottom of the vessel 302. The device 100 is illustrated in FIG. 3 with the optional sheath 110 partially surrounding the applicator 102.

Figure 4:
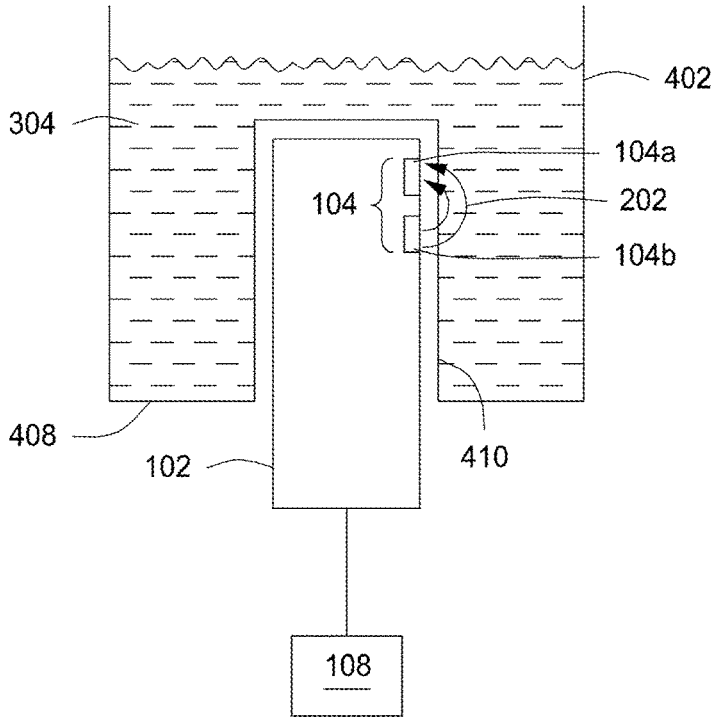
FIG. 4 is a side schematic view of the stirring device of FIG. 1 in use according to an embodiment of the invention.

In an alternate embodiment illustrated in FIG. 4, the bottom surface 408 of the vessel 402 includes an indented portion 410 into which the applicator 102 can be inserted. The applicator may fit partially (as shown) or wholly in the indented portion 410 which may obviate the need for sheath 110 to protect the applicator 102 from contact with the material 304 to be stirred.

At 508, a controllable power source 108 is electrically coupled to the applicator 102 as discussed above. In a preferred embodiment, the controllable power source 108 is separately coupled to the first and second electrodes 104*a*, 104*b* of the applicator 102 as described above.

The controllable power source 108 applies a controlled electrostatic charge to the applicator 102 at 508. In a preferred embodiment, the controllable power source 108 separately provides electrostatic charges to the separate first and second electrodes 104*a*, 104*b* as described above. At 510, the applicator 102 forms a controllable variable electric field 202 exterior to the applicator 102. As described above, an electric field may also be formed interior to the applicator 102.

The controllable variable electric field 202 influences the movement of the particles comprising the material 304 to be stirred. By appropriately controlling the electrostatic charges to the first and second electrodes 104*a*, 104*b*, a desired movement within the material 304 can be established. For instance, by controllably pulsing the electrostatic charge provided to the electrodes 104*a*, 104*b* between an energized state and a de-energized state of the same polarity to each electrode 104*a*, 104*b*, the controllable power source 108 can establish an electric field that varies in in one direction. Thus the electric field 202 can direct the particles of the material 304 in one direction corresponding to the direction of the electric field 202.

Similarly, by controllably pulsing the electrostatic charge to the first electrode 104*a* between a first polarity and a second polarity while simultaneously, within the limits above, pulsing the electrostatic charge to the second electrode between a second polarity and a first polarity, the controllable power source 108 can direct the particles of the material 304 in a first direction corresponding to the direction of the electric field 202 formed and then in a second direction corresponding to the direction of the electric field 204.

Properly pulsed electrostatic charges, either energized/de-energized or alternating polarity, can induce a desired stirring motion in the material 304. For example, the stirring motion may be circular in one direction around the applicator 102, or may be agitated between motion in a first circular direction and a second circular direction. Accordingly, at 512 the material is stirred using the variable electric field.

Having thus described the present invention in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A stirring device comprising:

an applicator comprising an electrically controllable element disposed on an outside surface of the applicator, wherein the electrically controllable element has at least a first electrode and a second electrode; and a controllable power source coupled to the electrically controllable element, wherein the first electrode and the second electrode are independently coupled to the controllable power source, and the controllable power source forms a variable electric field exterior to the outside surface of the applicator by independently controlling a controlled electrostatic charge provided to the first electrode and the second electrode.

2. The device of claim 1, wherein the electrostatic charge is pulsed between an energized condition and a de-energized condition.

3. The device of claim 1, wherein the controlled electrostatic charge is pulsed between a first polarity and a second polarity.

4. The device of claim 1 wherein the first electrode and the second electrode simultaneously receive an electrostatic charge of opposite polarity.

5. The device of claim 1, wherein the first electrode and the second electrode are simultaneously pulsed between an energized condition and a de-energized condition.

6. The device of claim 1, wherein the first electrode is pulsed between a first polarity and a second polarity simultaneously with the second electrode pulsed between a second polarity and a first polarity.

7. The device of claim 1, wherein the controllable power source controls one or more of amplitude and frequency.

8. A method of stirring comprising:

providing a vessel;

placing a material (substance) to be stirred in the vessel;

placing an applicator comprising an electrically controllable element disposed on an outside surface of the applicator in the vessel so that the electrically controllable element is disposed within the material to be stirred, or placing the applicator within an exterior region of a bottom surface of the vessel that is indented so that the electrically controllable element is disposed within the indent at a level between the bottom surface of the vessel and a top surface of the material to be stirred, wherein the electrically controllable element has at least a first electrode and a second electrode;

coupling a controllable power source to the electrically controllable element of the applicator, wherein the first electrode and the second electrode are independently coupled to the controllable power source;

applying a controlled electrostatic charge from the controllable power source to the electrically controllable element;

forming a variable electric field exterior to the outside surface of the applicator by independently controlling the controlled electrostatic charge provided to the first electrode and the second electrode of the electrically controllable element; and stirring the material using the variable electric field.

9. The method of claim 8, wherein the controlled electrostatic charge is pulsed between an energized condition and a de-energized condition.

10. The method of claim 8, wherein the controlled electrostatic charge is pulsed between a first polarity and a second polarity.

11. The method of claim 8, wherein the first electrode and the second electrode simultaneously receive an electrostatic charge of opposite polarity.

12. The method of claim 8, wherein the first electrode and the second electrode are pulsed between an energized and a de-energized condition.

13. The method of claim 8, wherein the first electrode is pulsed between a first polarity and a second polarity concurrently with the second electrode pulsed between a second polarity and a first polarity.

14. The method of claim 8, wherein the controllable power source controls one or more of amplitude and frequency.

15. The device of claim 1, wherein the applicator is at least partially inserted into a vessel containing a material to be stirred, and the controllable power source forms a variable electric field within the material to be stirred by independently controlling a controlled electrostatic charge provided to the first electrode and the second electrode.

16. The device of claim 1, wherein the applicator is at least partially inserted into an exterior region of a bottom surface of the vessel containing the material to be stirred, that is indented, and the controllable power source forms a variable electric field within the material to be stirred by independently controlling a controlled electrostatic charge provided to the first electrode and the second electrode.

* * * * *